US006719545B2

(12) United States Patent
Iizuka

(10) Patent No.: US 6,719,545 B2
(45) Date of Patent: Apr. 13, 2004

(54) SCROLL COMPRESSOR HAVING A BACK PRESSURE CHAMBER IN A ROTATION PREVENTING MECHANISM

(75) Inventor: Jiro Iizuka, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/367,860

(22) Filed: Feb. 19, 2003

(65) Prior Publication Data

US 2003/0156961 A1 Aug. 21, 2003

(30) Foreign Application Priority Data

Feb. 19, 2002 (JP) ..... 2002-040936

(51) Int. Cl.[7] ..... F04C 18/00

(52) U.S. Cl. ..... 418/55.3; 418/55.5; 418/57; 418/152; 464/102

(58) Field of Search ..... 418/55.3, 55.5, 418/57, 152; 464/102, 105

(56) References Cited

U.S. PATENT DOCUMENTS 4,325,683 A * 4/1982 Miyazawa ..... 418/55.3
4,468,181 A 8/1984 Sakamoto
4,810,176 A * 3/1989 Suefuji et al. ..... 418/55.3
4,958,993 A * 9/1990 Fujio ..... 418/55.3
5,102,315 A 4/1992 Terauchi et al.
5,511,959 A * 4/1996 Tojo et al. ..... 418/55.3
5,704,773 A 1/1998 Higashiyama
5,899,676 A 5/1999 Iizuka
6,030,193 A 2/2000 Kimura
6,120,269 A 9/2000 Iizuka et al.
6,139,292 A 10/2000 Kimura

FOREIGN PATENT DOCUMENTS

JP 63129182 6/1988
JP 01227885 A * 9/1989 ..... F04C/18/02
JP 10317902 A * 2/1998 ..... F04C/18/02

* cited by examiner

*Primary Examiner*—Thomas Denion
*Assistant Examiner*—Theresa Trieu
(74) *Attorney, Agent, or Firm*—Baker Botts L.L.P.

(57) ABSTRACT

In a scroll compressor in which a movable scroll is placed between a housing and a fixed scroll to define a compression chamber in cooperation with the fixed scroll, an Oldham ring slidably interposed between the housing and the movable scroll to regulate a motion of the movable scroll. The Oldham ring has a space forming a back pressure chamber between the housing and the movable scroll. The movable scroll has a through hole allowing the compression chamber to communicate with the back pressure chamber.

14 Claims, 5 Drawing Sheets

SCROLL COMPRESSOR HAVING A BACK PRESSURE CHAMBER IN A ROTATION PREVENTING MECHANISM

BACKGROUND OF THE INVENTION

This application claims priority to prior application JP 2002-040936, the disclosure of which is incorporated herein by reference.

The present invention relates to a scroll compressor.

In general, a scroll compressor includes a movable scroll driven to make an orbital motion, a fixed scroll defining working spaces, i.e. compression chambers, cooperatively with the movable scroll, and a rotation preventing mechanism for the movable scroll. For the purpose of ensuring seal tightness between the movable scroll and the fixed scroll, JP-A-S63-129182, for example, discloses a scroll compressor wherein a back pressure chamber is formed at the back of an end plate of a movable scroll, and high-pressure refrigerant gas being compressed is conducted into the back pressure chamber via a through hole formed at the center of the end plate of the movable scroll. The disclosed scroll compressor is expected to prevent refrigerant gas being compressed from leaking through sliding portions between a spiral wrap of the movable scroll and an end plate of a fixed scroll and between a spiral wrap of the fixed scroll and the end plate of the movable scroll during operation of a compressor.

In the disclosed scroll compressor, however, because substantially the whole of a space at the back of the end plate of the movable scroll, excluding those portions adjacent to the periphery of the end plate, serves as the back pressure chamber, it is not possible to cool relevant portions using sucked refrigerant gas. Specifically, in an open type compressor that is driven by an external driving source such as a vehicular engine, it is not possible to cool a shaft seal device arranged at the back of a movable scroll using sucked refrigerant gas, or in a hermetic compressor driven by a built-in electric motor, it is not possible to cool the electric motor and its associated components disposed at the back of a movable scroll using sucked refrigerant gas. Consequently, there is a possibility of lowering of durability of the shaft seal device or the motor etc. and thus lowering of reliability of the compressor.

SUMMARY OF THE INVENTION

It is therefore an object of the present invention to provide a scroll compressor that improves a prevention effect against leakage of refrigerant gas being compressed, without impeding cooling of relevant portions using sucked refrigerant gas.

Other objects of the present invention will become clear as the description proceeds.

According to one aspect of the present invention, there is provided a scroll compressor comprising a housing, a fixed scroll, a movable scroll placed between the housing and the fixed scroll to define a compression chamber in cooperation with the fixed scroll; and an Oldham ring slidably interposed between the housing and the movable scroll to regulate a motion of the movable scroll, the Oldham ring having a space forming a back pressure chamber between the housing and the movable scroll, the movable scroll having a through hole allowing the compression chamber to communicate with the back pressure chamber.

DESCRIPTION OF THE PREFERRED EMBODIMENT

Figure 1:
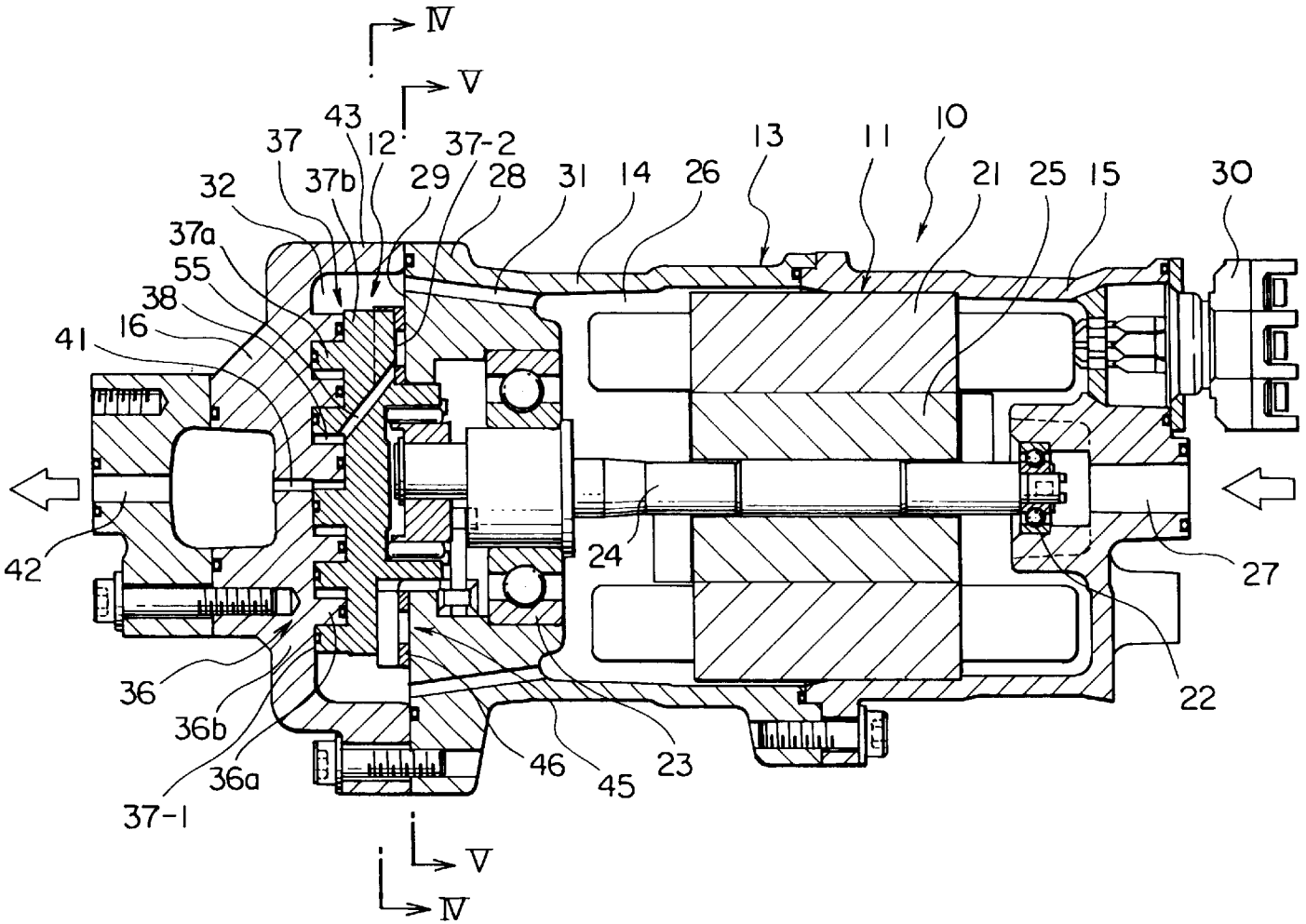
FIG. 1 is a side sectional view of a scroll compressor according to an embodiment of the present invention.

Referring to FIG. 1, description will be made as regards a scroll compressor according to an embodiment of the present invention.

The shown scroll compressor 10 is of a hermetic type and can be used in a vehicular air conditioner known in the art. The scroll compressor 10 comprises an electric motor 11, a scroll type compressing portion 12 driven by the electric motor 11, and a housing 13 receiving therein the electric motor 11 and the scroll type compressing portion 12. The housing 13 comprises a cylindrical center housing 14, a bottomed cylindrical rear housing 15 joined to one axial end of the center housing 14, and a front housing 16 joined to the other axial end of the center housing 14.

The electric motor 11 comprises a stator 21 fixed to the housing 13, an output shaft 24 rotatably supported relative to the housing 13 by means of bearings 22 and 23, and a rotor 25 confronting the stator 21 and fixed to the output shaft 24. The power is fed to the electric motor 11 via a terminal assembly 30 attached to an end wall of the rear housing 15 in a sealed state.

The center housing 14 and the rear housing 15 define internal spaces, respectively, which are communicated with each other to form a first suction chamber 26. The end wall of the rear housing 15 is formed with a suction port 27 communicating with the suction chamber 26. The center housing 14 has a boss 28 in the neighborhood of the other axial end thereof. The other axial end of the center housing 14 is in the form of a flat end surface 29. The boss 28 is formed with a gas flow passage 31. The gas flow passage 31 has one end communicating with the suction chamber 26 and the other end communicating with a second suction chamber 32 which will later be described.

The scroll type compressing portion 12 comprises a fixed scroll 36 formed as part of the front housing 16, and a movable scroll 37 confronting the fixed scroll 36 in an axial direction. More particularly, the movable scroll 37 has a first surface 37-1 facing the fixed scroll 36 in the axial direction and a second surface 37-2 opposite to the first surface 37-1 in the axial direction. The fixed scroll 36 has a spiral wrap 36*a* and an end plate 36*b*, while the movable scroll 37 has a spiral wrap 37*a* and an end plate 37*b*. The spiral wrap 36*a* and the spiral wrap 37*a* interfit or mesh with each other to define therebetween a plurality of compression chambers or working chambers 38. At the center of the end plate 36*b* of the fixed scroll 36 is formed a discharge hole 41 that can communicate with the radially innermost working chamber 38. The front housing 16 is further formed with a discharge port 42 communicating with the discharge hole 41. The movable scroll 37 engages the output shaft 24 of the electric motor 11.

The outer periphery of the end plate 36*b*, i.e. the front housing 16, forms a cylindrical portion 43 extending in parallel to the spiral wrap 36*a*. The cylindrical portion 43 is joined to the other axial end of the center housing 14. An internal space of the cylindrical portion 43 forms the suction chamber 32 surrounding the spiral wraps 36*a* and 37*a*. The suction chamber 32 communicates with the first suction chamber 26 via the gas flow passage 31.

The movable scroll 37 is allowed to make an orbital motion while prevented from rotation on its axis. For preventing the rotation of the movable scroll 37, the scroll type compressing portion 12 employs an Oldham coupling 45 serving as a rotation preventing mechanism.

Figure 2:
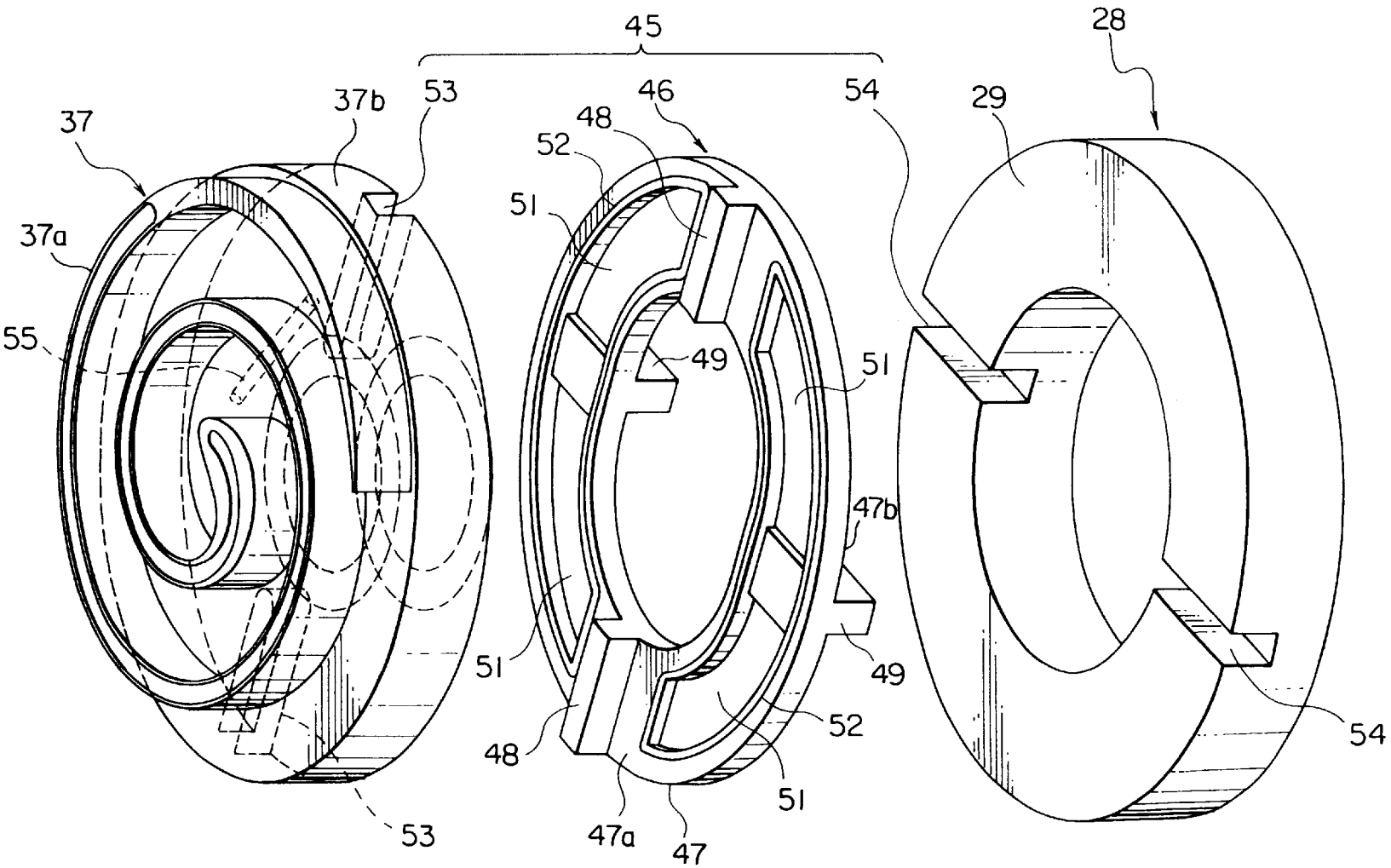
FIG. 2 is an exploded perspective view of an Oldham coupling incorporated in the scroll compressor of FIG. 1.

Referring to FIG. 2 in addition, the description will be directed to the Oldham coupling 45.

The Oldham coupling 45 includes an Oldham ring 46 disposed between the boss 28 of the center housing 14 and the movable scroll 37. The Oldham ring 46 has a flat-plate ring portion 47. The ring portion 47 has a first end surface 47*a* slidably contacting with a back surface of the end plate 37*b* of the movable scroll 37, and a second end surface 47*b* slidably contacting with the end surface 29 of the center housing 14.

In point-symmetrical positions with respect to the center of the ring portion 47, the first end surface 47*a* of the ring portion 47 is formed thereon with a pair of first key-shaped projections 48 that extend diametrally in a first direction in an aligned manner. In point-symmetrical positions with respect to the center of the ring portion 47, the second end surface 47*b* of the ring portion 47 is formed thereon with a pair of second key-shaped projections 49 that extend diametrally in a second direction perpendicular to the first direction in an aligned manner. The extending directions of the first projections 48 and the second projections 49 are orthogonal to each other.

Four spaces 51 each extending through the ring portion 47 in a thickness direction thereof are formed at those portions each of which extends between the corresponding first projection 48 and the corresponding second projection 49 and is constantly held in slidable contact with the back surface of the end plate 37*b* of the movable scroll 37 and the end surface 29 of the center housing 14. Namely, the ring portion 47 has four arc-shaped portions each being between the adjacent first and second projections 48 and 49, and the spaces 51 are formed at the arc-shaped portions, respectively. These spaces 51 communicate with each other to form a later-described back pressure chamber. Accordingly, the back pressure chamber extends annularly along the ring portion 47.

Two semi-annular seal members 52 are embedded on each of the end surfaces 47*a* and 47*b* of the ring portion 47 so as to surround the spaces 51. By means of these seal members 52, the spaces 51 are sealed against the exterior.

The end plate 37*b* of the movable scroll 37 is formed thereon with a pair of first grooves 53 that extend diametrally to interfit slidably with the first projections 48, respectively. The end surface 29 of the center housing 14 is formed thereon with a pair of second grooves 54 that extend diametrally to interfit slidably with the second projections 49, respectively. At a center portion of the end plate 37*b* is formed a through hole 55 perforating therethrough in a thickness direction of the end plate 37*b*. The through hole 55 extends so that the working chamber 38 located at the center of the scroll type compressing portion 12 communicates with a given one of the four spaces 51.

When the electric motor 11 is driven by the power fed from a non-shown power supply, the movable scroll 37 is driven through the output shaft 24 of the electric motor 11. In this event, the movable scroll 37 makes a relative motion in the first direction with respect to the Oldham ring 46, while the movable scroll 37 and the Oldham ring 46 make a relative motion in the second direction with respect to the end surface 29 of the center housing 14. Therefore, the movable scroll 37 makes a swing motion, i.e. an orbital motion, while being prevented from rotation on its axis.

Following the orbital motion of the movable scroll 37, refrigerant gas circulating from an external refrigerant circuit flow into the suction chamber 26 through the suction port 27. Refrigerant gas passes through components of the electric motor 11 and flow passages defined among the components, and further passes through the gas flow passage 31 to enter the suction chamber 32. Refrigerant gas in the suction chamber 32 is forced into the working chambers 38 of the scroll type compressing portion 12 and moved radially inward while reducing its volume to be compressed, and then flows out toward the external refrigerant circuit through the discharge hole 41 and the discharge port 42.

In the foregoing scroll compressor 10, the four spaces 51 formed in the ring portion 47 cooperatively form the back pressure chamber. High-pressure refrigerant gas being compressed in the working chamber 38 is introduced into the back pressure chamber via the through hole 55 formed in the center portion of the end plate 37*b* of the movable scroll 37. The movable scroll 37 is pushed toward the fixed scroll 36 by an internal pressure within the back pressure chamber. Consequently, refrigerant gas being compressed is prevented from leaking through sliding portions between the spiral wrap 37*a* of the movable scroll 37 and the end plate 36*b* of the fixed scroll 36 and between the spiral wrap 36*a* of the fixed scroll 36 and the end plate 37*b* of the movable scroll 37. Further, because the four spaces 51 formed at the portions of the ring portion 47 that are constantly held in slidable contact with the end plate 37*b* of the movable scroll 37 and the end surface 29 of the center housing 14 form the back pressure chamber, a space receiving therein the bearings 22 and 23 and the electric motor 11 disposed behind the end plate 37*b* of the movable scroll 37 can be used as the suction chamber 26. In addition, because the bearings 22 and 23 and the electric motor 11 are cooled by sucked refrigerant gas in the suction chamber 26, the durability of the members constituting them is improved so that the reliability of the compressor is improved. Moreover, the semi-annular seal members 52 prevent leakage of high-pressure refrigerant gas within the back pressure chamber into the space behind the end plate 37*b* of the movable scroll 37 via sliding portions between the ring portion 47 and the end plate 37*b* of the movable scroll 37 and between the ring portion 47 and the end surface 29 of the center housing 14. Consequently, the lowering of compression efficiency of the scroll compressor 10 is prevented.

It is desirable that the through hole 55 intermittently communicates with the space 51 following the relative motion between the movable scroll 37 and the Oldham ring 46. With this arrangement, leakage of high-pressure refrigerant gas being compressed into the space behind the end plate 37*b* of the movable scroll 37 is suppressed so that the lowering of compression efficiency of the scroll compressor 10 is suppressed. On the other hand, it may also be configured that the through hole 55 constantly communicates with the space 51 forming the back pressure chamber.

The ring portion 47 may be made of a material having self-lubricity such as sintered metal impregnated with lubricating oil. With this arrangement, the sliding resistance between the ring portion 47 and the end plate 37*b* of the movable scroll 37 is reduced, and the sliding resistance between the ring portion 47 and the end surface 29 of the center housing 14 is reduced. Consequently, energy consumption of the scroll compressor 10 is reduced.

Each semi-annular seal member 52 is preferably made of a material having self-lubricity such as fluorine contained resin. With this arrangement, the sliding resistance between each seal member 52 and the end plate 37*b* of the movable scroll 37 is reduced, and the sliding resistance between each seal member 52 and the end surface 29 of the center housing 14 is reduced. Consequently, energy consumption of the scroll compressor 10 is reduced.

Referring also to FIGS. 3 to 5B along with FIG. 1, the description will be made as regards another example of an Oldham coupling. Similar portions or parts are designated by like reference symbols, thereby to omit explanation thereof.

Figure 3:
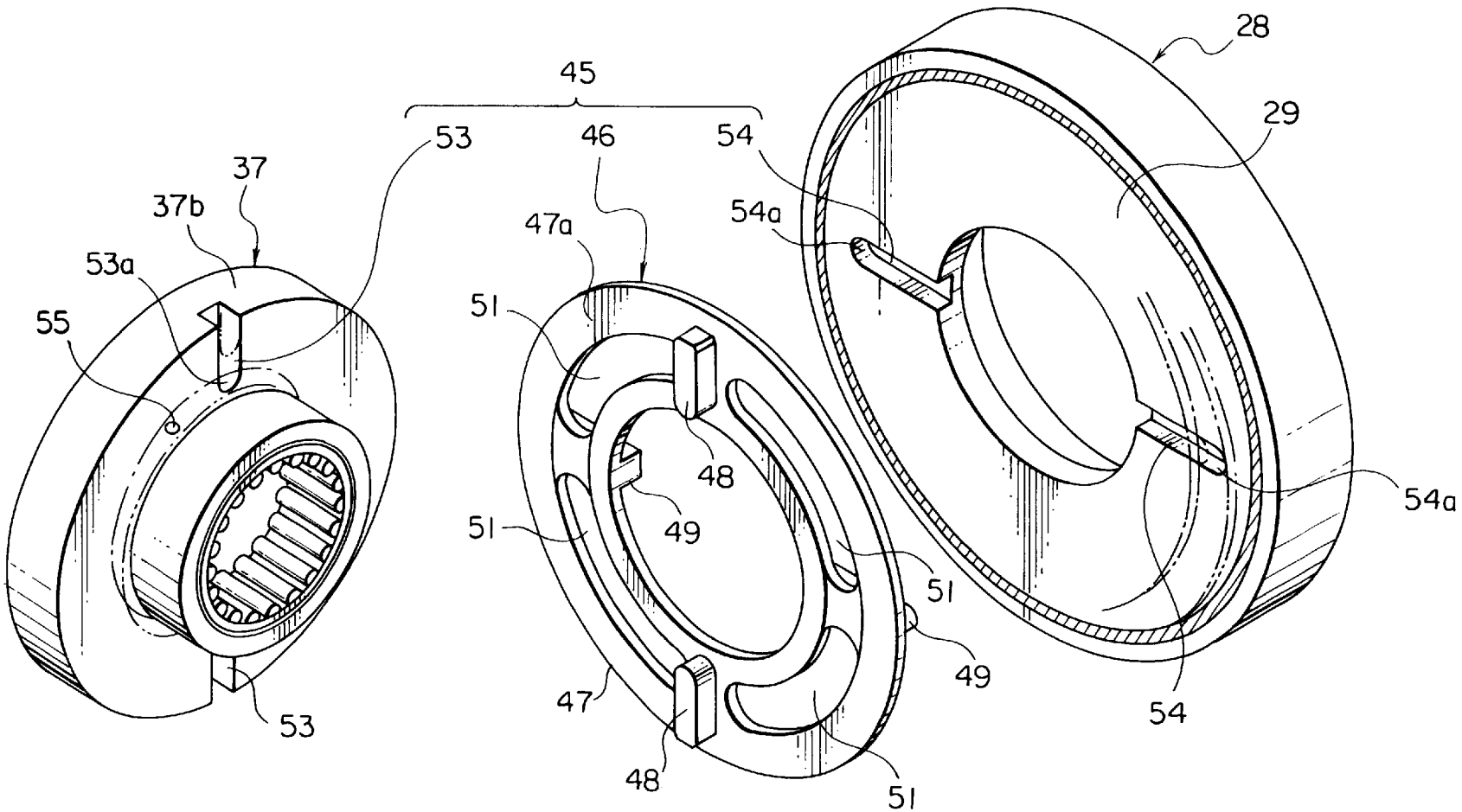
FIG. 3 is an exploded perspective view of an Oldham coupling of another example.
Figure 4A:
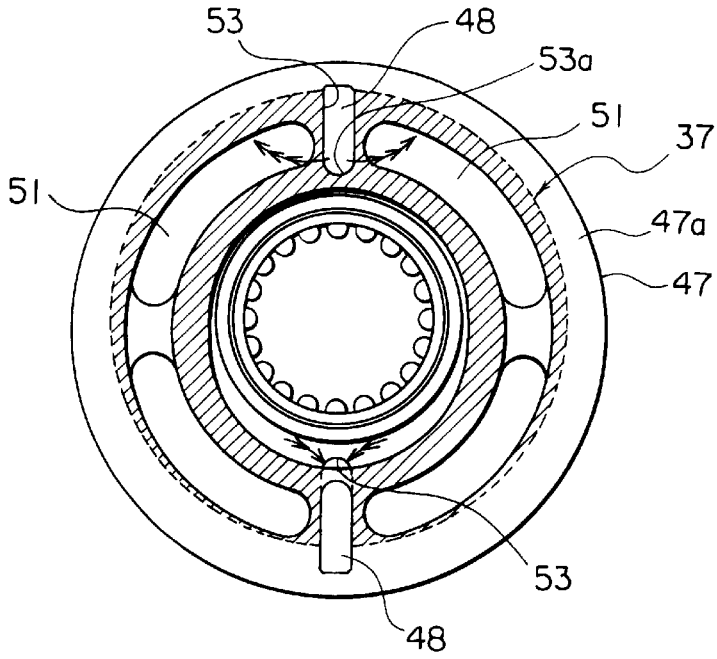
FIGS. 4A and 4B are sectional views taken along line IV—IV of FIG. 1.
Figure 4B:
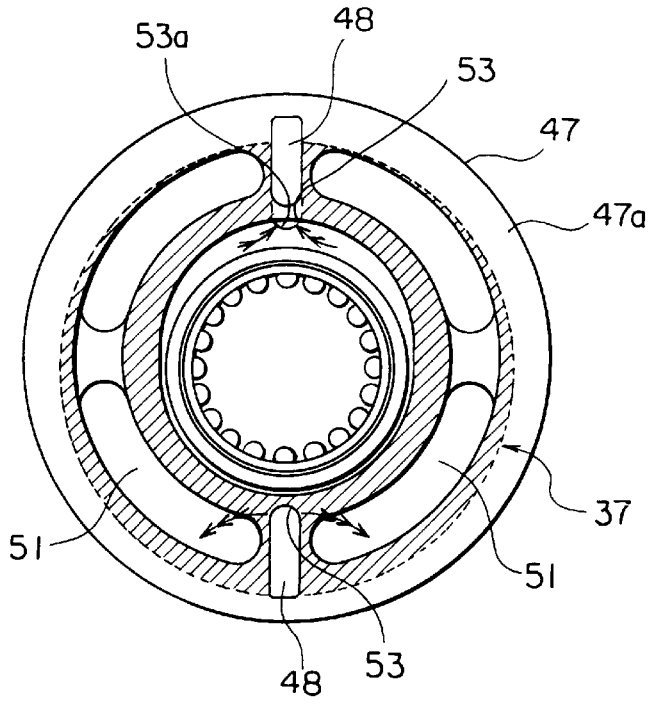

In FIGS. 3, 4A and 4B, a movable scroll 37 has an inner end wall 53*a* that closes a radially inner end of each of first grooves 53. With this arrangement, when the movable scroll 37 makes a relative motion in the first direction with respect to an Oldham ring 46, a portion near the inner end wall 53*a* of the first groove 53 protrudes radially inward from the inner periphery of the ring portion 47 as shown in FIG. 3 by one-dot chain line, FIG. 4A at a lower part thereof and FIG. 4B at an upper part thereof, or the first groove 53 is entirely covered with the ring portion 47 as shown in FIG. 3 by two-dot chain line, FIG. 4A at an upper part thereof and FIG. 4B at a lower part thereof. Consequently, each of first projections 48 and the corresponding first groove 53 forms a pump.

When the portion near the inner end wall 53*a* of the first groove 53 protrudes radially inward from the inner periphery of the ring portion 47, lubricating oil is introduced into the first groove 53 from the portion near the inner end wall 53*a* as shown by double arrows in FIG. 4A or 4B. Then, following the relative motion of the movable scroll 37 with respect to the Oldham ring 46, the whole of the first groove 53 is covered with the ring portion 47, and the first projection 48 interfitting with the first groove 53 approaches the inner end wall 53*a* of the first groove 53 to pressurize lubricating oil in the first groove 53. As shown by triple arrows in FIG. 4A or 4B, the pressurized lubricating oil is conveyed into the spaces 51 from a peripheral region of the first groove 53 via the sliding portions between the end plate 37*b* of the movable scroll 37 and the ring portion 47.

Figure 5A:
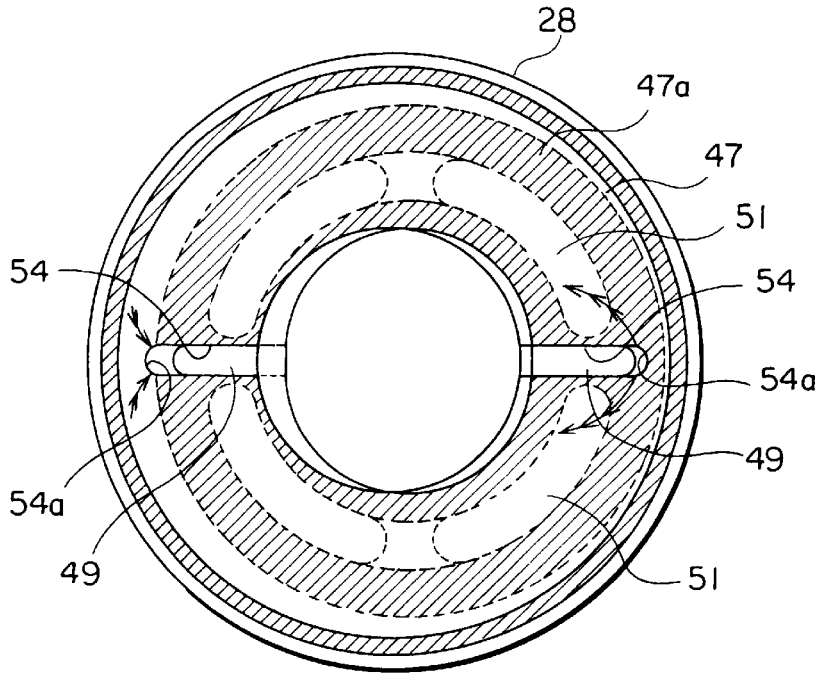
FIGS. 5A and 5B are sectional views taken along line V—V of FIG. 1.
Figure 5B:
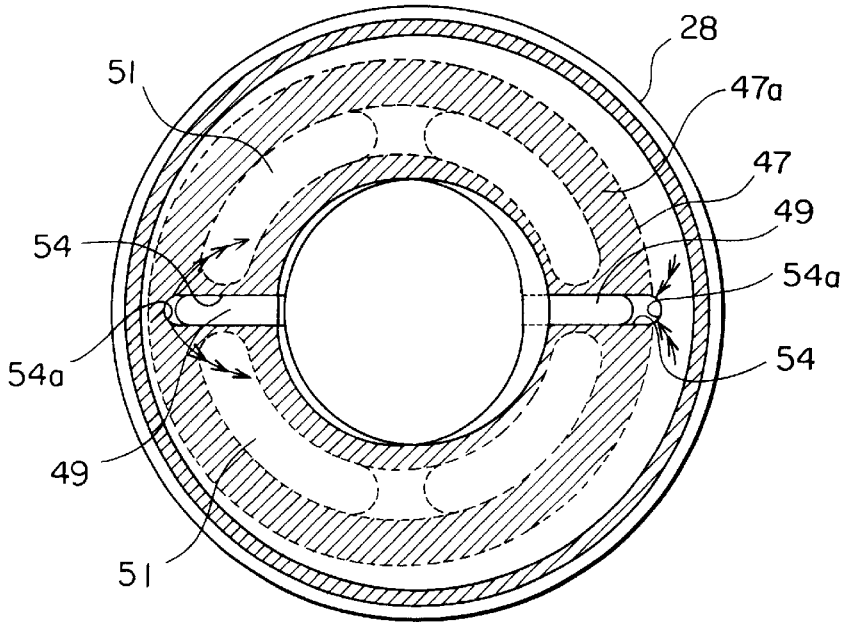

In FIGS. 3, 5A and 5B, a boss 28 of a center housing 14 has an outer end wall 54*a* that closes a radially outer end of each of second grooves 54. With this arrangement, when the movable scroll 37 and the Oldham ring 46 make a relative motion in the second direction with respect to an end surface 29 of the center housing 14, a portion near the outer end wall 54*a* of the second groove 54 protrudes radially outward from the outer periphery of the ring portion 47 as shown in FIG. 3 by one-dot chain line, FIG. 5A at a left part thereof and FIG. 5B at a right part thereof, or the second groove 54 is entirely covered with the ring portion 47 as shown in FIG. 3 by two-dot chain line, FIG. 5A at a right part thereof and FIG. 5B at a left part thereof. Consequently, each of second projections 49 and the corresponding second groove 54 forms a pump.

When the portion near the outer end wall 54*a* of the second groove 54 protrudes radially outward from the outer periphery of the ring portion 47, lubricating oil is introduced into the second groove 54 from the portion near the outer end wall 54*a* as shown by double arrows in FIG. 5A or 5B. Then, following the relative motion of the movable scroll 37 with respect to the Oldham ring 46, the whole of the second groove 54 is covered with the ring portion 47, and the second projection 49 interfitting with the second groove 54 approaches the outer end wall 54*a* of the second groove 54 to pressurize lubricating oil in the second groove 54. As shown by triple arrows in FIG. 5A or 5B, the pressurized lubricating oil is conveyed into the spaces 51 from a peripheral region of the second groove 54 via the sliding portions between the end surface 29 of the center housing 14 and the ring portion 47.

Using lubricating oil thus retained in the spaces 51, the sliding portions between the Oldham ring 46 and the end plate 37*b* of the movable scroll 37 and between the Oldham ring 46 and the end surface 29 of the center housing are sufficiently lubricated. Because the prevention effect against leakage of refrigerant gas being compressed is high, carbon dioxide can be used as refrigerant gas which is circulated through a refrigerating cycle including the scroll compressor.

While the present invention has thus far been described in connection with a single embodiment thereof, it will readily be possible for those skilled in the art to put this invention into practice in various other manners. For example, although the description has been made of the hermetic compressor driven by the electric motor in the foregoing embodiment, the present invention is also applicable to an open type compressor having a scroll type compressing portion that is driven by an external driving source such as a vehicular engine.

What is claimed is:

1. A scroll compressor comprising:

a housing comprising a cylindrical center housing, a bottomed cylindrical rear housing, and a front housing;

a fixed scroll;

a movable scroll placed between said cylindrical center housing and said fixed scroll to define a compression chamber in cooperation with said fixed scroll; and an Oldham ring slidably interposed between said cylindrical center housing and said movable scroll to regulate a motion of said movable scroll, said Oldham ring having a space forming a back pressure chamber between said cylindrical center housing and said movable scroll, said movable scroll having a through hole allowing said compression chamber to communicate with said back pressure chamber.

2. The scroll compressor as claimed as claim 1, wherein said movable scroll comprises an end plate confronting said cylindrical center housing, said Oldham ring comprising:

a ring portion having a first end surface slidably contacting said end plate of said movable scroll, and a second end surface slidably contacting said cylindrical center housing;

a first projection formed on said first end surface of said ring portion and extending in a first direction; and a second projection formed on said second end surface of said ring portion and extending in a second direction perpendicular to said first direction, said end plate of said movable scroll having a first groove that slidably interfits with said first projection, said cylindrical center housing having a second groove that slidably interfits with said second projection, a combination of said Oldham ring, said first groove, and said second groove forming an Oldham coupling.

3. The scroll compressor as claimed as claim 2, wherein said space is formed in said ring portion, said through hole being formed in said end plate of said movable scroll.

4. The scroll compressor as claimed as claim 3, wherein said ring portion has arc-shaped portions each formed between said first and second projections, said space being formed at each of said arc-shaped portions.

5. The scroll compressor as claimed as claim 3, wherein said back pressure chamber extends annularly along said ring portion.

6. The scroll compressor as claimed as claim 5, wherein said ring portion is provided with a seal member sealing said back pressure chamber.

7. The scroll compressor as claimed as claim 6, wherein said seal member is made of a material having self-lubricity.

8. The scroll compressor as claimed as claim 2, wherein said ring portion is made of a material having self-lubricity.

9. The scroll compressor as claimed as claim 2, wherein lubricating oil is fed to said through hole by at least one of a first pump that is formed by said first projection and said first groove cooperatively with each other, and a second pump that is formed by said second projection and said second groove cooperatively with each other.

10. The scroll compressor as claimed as claim 1, wherein said through hole intermittently communicates with said back pressure chamber following a relative motion between said movable scroll and said Oldham ring.

11. The scroll compressor as claimed as claim 1, wherein said cylindrical center housing defines a suction chamber and having a passage intermittently communicating said suction chamber with a first suction chamber.

12. The scroll compressor as claimed as claim 11, further comprising an electric motor placed in said first suction chamber and connected to said movable scroll for driving said movable scroll.

13. The scroll compressor as claimed in claim 1, which is used for compressing refrigerant gas.

14. The scroll compressor as claimed in claim 13, wherein carbon dioxide is used as said refrigerant gas.

* * * * *